US009498046B2

(12) United States Patent
Hwang

(10) Patent No.: US 9,498,046 B2
(45) Date of Patent: Nov. 22, 2016

(54) TWO-IN-ONE APPARATUS COMPRISING COSMETIC BRUSH AND SPONGE

(71) Applicant: Jae Kwang Hwang, Seoul (KR)

(72) Inventor: Jae Kwang Hwang, Seoul (KR)

( * ) Notice: Subject to any disclaimer, the term of this patent is extended or adjusted under 35 U.S.C. 154(b) by 0 days.

(21) Appl. No.: 14/432,455

(22) PCT Filed: Mar. 17, 2014

(86) PCT No.: PCT/KR2014/002234

§ 371 (c)(1),
(2) Date: Mar. 30, 2015

(87) PCT Pub. No.: WO2014/163306

PCT Pub. Date: Oct. 9, 2014

(65) Prior Publication Data

US 2016/0007716 A1 Jan. 14, 2016

(30) Foreign Application Priority Data

Apr. 2, 2013 (KR) ..... 10-2013-0036003

(51) Int. Cl.

| | |
|---|---|
| ***A45D 40/24*** | (2006.01) |
| ***A45D 34/06*** | (2006.01) |
| ***A45D 33/00*** | (2006.01) |
| ***A46B 9/02*** | (2006.01) |
| ***A45D 33/28*** | (2006.01) |
| ***A46B 5/00*** | (2006.01) |
| ***A46B 9/00*** | (2006.01) |
| ***A45D 33/34*** | (2006.01) |
| ***A45D 34/04*** | (2006.01) |
| *A45D 40/26* | (2006.01) |

(52) U.S. Cl.

CPC ..... *A45D 34/06* (2013.01); *A45D 33/00* (2013.01); *A45D 33/28* (2013.01); *A45D 33/34* (2013.01); *A45D 34/04* (2013.01); *A46B 5/0008* (2013.01); *A46B 9/005* (2013.01); *A46B 9/021* (2013.01); *A45D 40/262* (2013.01); *A45D 2200/1009* (2013.01); *A46B 2200/1046* (2013.01)

(58) Field of Classification Search

CPC .... A45D 33/00; A45D 33/025; A45D 33/34; A45D 34/04; A45D 34/06; A45D 34/041; A45D 34/042; A45D 40/18; A45D 40/205; A45D 40/24; A45D 40/261; A45D 40/262; A45D 2040/205; A45D 2200/25

See application file for complete search history.

(56) References Cited

U.S. PATENT DOCUMENTS

| | | | | |
|---|---|---|---|---|
| 6,035,865 | A * | 3/2000 | Krieger | A45D 34/06 132/293 |
| 7,287,923 | B1 * | 10/2007 | Chen | A45D 40/24 132/317 |
| 2010/0322694 | A1 | 12/2010 | Kim | |

FOREIGN PATENT DOCUMENTS

| | | | |
|---|---|---|---|
| EP | 1 712 487 | A1 | 10/2006 |
| EP | 1 922 951 | A1 | 5/2008 |
| EP | 2 119 378 | A2 | 11/2009 |
| KR | 200406850 | Y1 | 1/2006 |
| KR | 200453975 | Y1 | 6/2011 |
| KR | 2020110006126 | U | 6/2011 |
| WO | WO 2006/090971 | A1 | 8/2006 |

* cited by examiner

*Primary Examiner* — Rachel Steitz
(74) *Attorney, Agent, or Firm* — East West Laaw Group; Heedong Chae

(57) ABSTRACT

The present invention relates to a two-in-one apparatus comprising a cosmetic brush and sponge, comprising a cosmetic brush container (10) and a cosmetic sponge container (20) which are symmetrical to each other and are rotatably attached in contact.

6 Claims, 3 Drawing Sheets

TWO-IN-ONE APPARATUS COMPRISING COSMETIC BRUSH AND SPONGE

CROSS-REFERENCE TO RELATED APPLICATION

This application claims the benefit of Korean Application No. 10-2013-0036003, filed on Apr. 2, 2013 with the Korean Intellectual Property Office, the disclosure of which is incorporated herein by reference.

BACKGROUND OF THE INVENTION

Field of the Invention

The present invention relates to a two-in-one apparatus comprising a cosmetic brush and sponge and more particularly, to a two-in-one apparatus which is capable of providing both of a brush and a sponge for cosmetics.

Description of the Related Art

A brush for cosmetic make-up is used for blushing in base make-up or overall make-up. For example, the brush is used to include a color in a cheek or around eyes and enables representations such as gradations.

A sponge for make-up can be used in both of dry and wet conditions. In particular, the sponge can be conveniently used to cleanly apply liquid-typed make-up base or a foundation. The sponge is a tool essential for clean skin representation since it can apply the make-up base or the foundation more meticulously than a case where lingers are used to do so.

In recent years, cosmetic tool such as sponges have been used by not only make-up specialists but also public users and are in increasing demand. In actuality, even in make-up base, in addition to a power puff, a brush for blushing and a sponge for application of make-up base are generally used depending on their functions.

Nevertheless, in the prior art, a brush and a sponge have to be prepared separately, which causes an inconvenience to users, and, in actuality, are not easy to be carried by the users. In addition, if the sponge remains wet after using it, it is not easy to keep the sponge separately irons other cosmetics or cosmetic tools.

With development of various kinds of cosmetics with advance of general make-up techniques, many more users have used both, of the brush and the sponge as tools for cosmetics. However, there has been conventionally no cosmetic tool to support the two functions.

As conventional techniques, a portable brush for make-up is disclosed in KR Patent Application No. 1999-018229 (titled as "Brush for Make-up"), KR Utility Model Registration Application No. 1987-008064 (titled as "Cheek Rouge Brush"), KR Utility Model Registration Application No. 1992-024360 (titled as "Brush for Make-up"), KR Utility Model Registration Application No. 1994-002014 (titled as "Portable Brush for Make-up") and KR Utility Model Registration Application No. 1991-00029 (titled as "Portable Brush for Make-up"). However, these techniques are only limited to a brush for blushing.

SUMMARY OF THE INVENTION

The present invention has been made to overcome the above problems and it is an object of the present invention to provide a two-in-one apparatus which is capable of providing both of a brush and a sponge for cosmetics.

To achieve the above object, according to an aspect of the invention, there is provided a two-in-one apparatus having a brush and a sponge for cosmetics according to the present invention includes a cosmetic brush container and a cosmetic sponge container which are symmetrical to each other and are rotatably attached in contact.

The cosmetic brush container has a cylindrical shape and is formed with a contact surface in contact with the cosmetic sponge container. A brush is inserted in the upper side of the cosmetic brush container. A cover member to cover the bottom of the cosmetic brush container and a cutout portion formed in the lower part of the contact surface is inserted in the lower side of the cosmetic brush container. A cylindrical projection projecting toward the cosmetic sponge container is formed in the upper part of the cutout portion of the contact surface.

The cosmetic sponge container has a cylindrical shape and is formed with a contact surface in contact with the cosmetic brush container. A sponge is inserted in the upper side of the cosmetic sponge container. A cover member to cover the bottom of the cosmetic sponge container and a cutout portion formed in the lower part of the contact surface is inserted in the lower side of the cosmetic sponge container. A round portion to be inserted and mounted in the periphery of the cylindrical projection of the cosmetic brush container is formed in the upper part of the cutout portion of the contact surface.

According to the present invention, a two-in-one apparatus having a brush and a sponge for cosmetics includes a cosmetic brush container and a cosmetic sponge container which are symmetrical to each other and are rotatably attached in contact. This allows a user to optionally use the brush and the sponge with convenience.

BRIEF DESCRIPTION OF THE DRAWINGS

The above and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENT

According to an aspect of the invention, there is provided a two-in-one apparatus having a brush and a sponge for cosmetics according to the present invention includes a cosmetic brush container and a cosmetic sponge container which are symmetrical to each other and are rotatably attached in contact.

Hereinafter, preferred embodiments of the present invention will be described in detail with reference to the accompanying drawings. In the following detailed description of the present invention, concrete description on related functions or constructions will be omitted if it is deeded that the functions and/or constructions may unnecessarily obscure the gist of the present invention.

Embodiment

Figure 1:
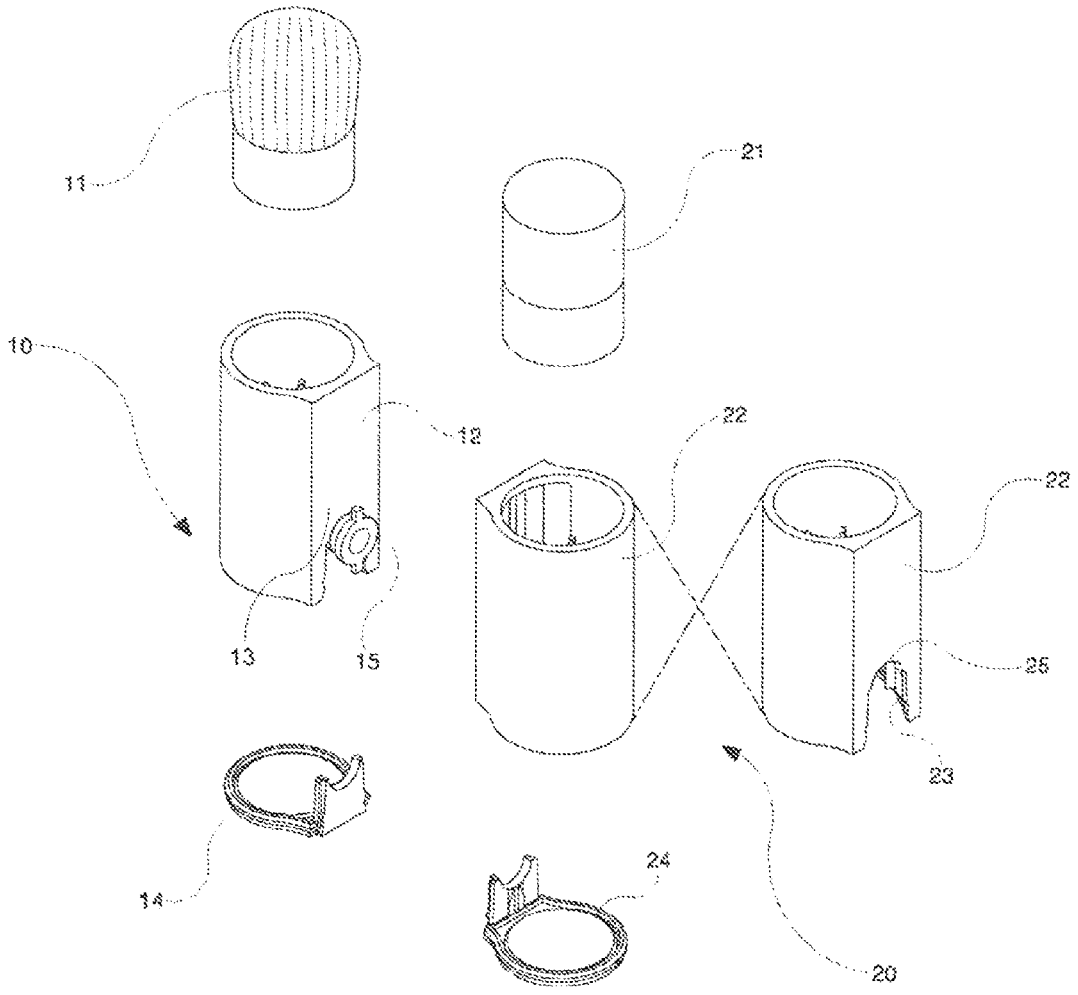
FIG. 1 is an exploded perspective view showing a two-in-one apparatus having a brush and a sponge for cosmetics, according to the present invention.
Figure 2:
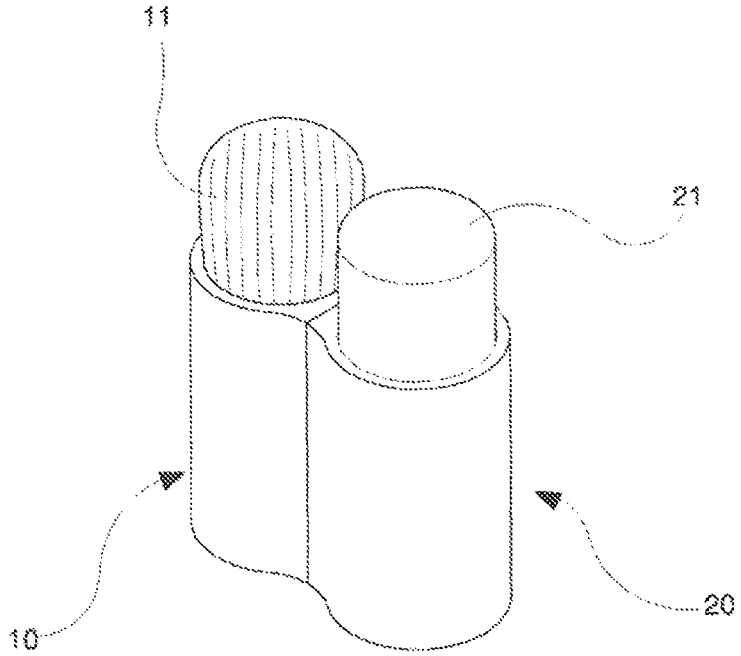
FIG. 2 is an external appearance perspective view showing the two-in-one apparatus having the brush and the sponge for cosmetics, according to the present invention.
Figure 3:
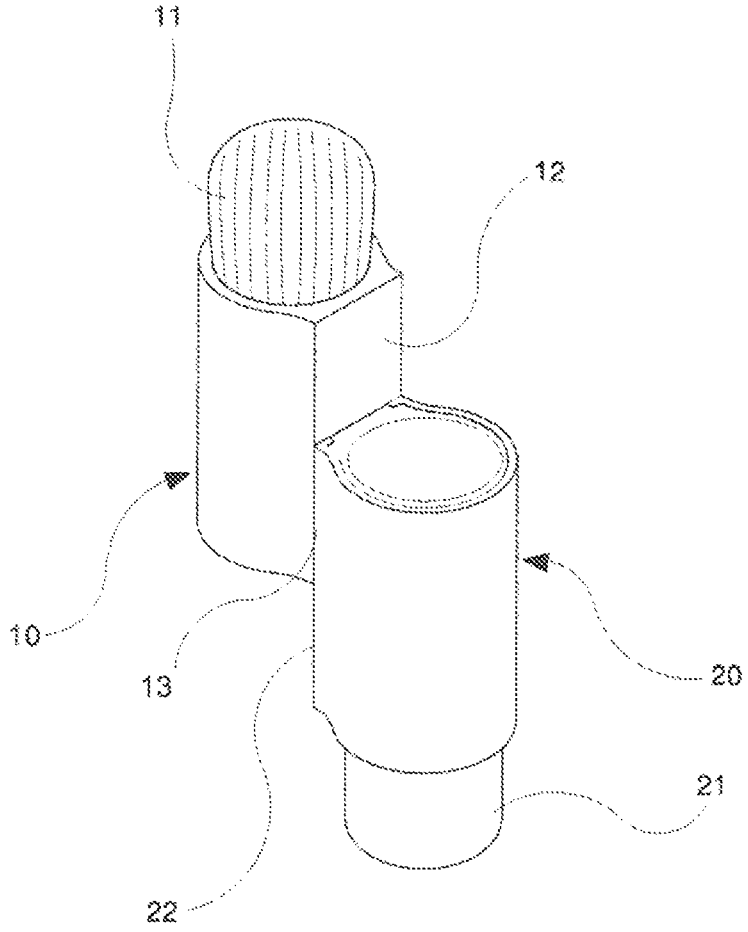
FIG. 3 is an external appearance perspective view showing a state the two-in-one apparatus having the brush and the sponge for cosmetics, according to the present invention.

FIG. 1 is an exploded perspective view showing a two-in-one apparatus having a brush and a sponge for cosmetics, according to the present invention, FIG. 2 is an external appearance perspective view showing the two-in-one apparatus having the brush and the sponge for cosmetics, according to the present invention, and FIG. 3 is an external appearance perspective view showing a state the two-in-one apparatus having the brush and the sponge for cosmetics, according to the present invention.

As shown in FIGS. 1 to 3, a two-in-one apparatus having a brush and a sponge for cosmetics according to the present invention includes a cosmetic brush container 10 and a cosmetic sponge container 20 which are symmetrical to each other and are rotatably attached in contact.

The cosmetic brush container 10 has a cylindrical shape and is formed with a contact surface 12 in contact with the cosmetic sponge container 20. A brush 11 is inserted in the upper side of the cosmetic brush container 10. A cover member 14 to cover the bottom of the cosmetic brush container 10 and a cutout portion 13 formed in the lower part of the contact surface 12 is inserted in the lower side of the cosmetic brush container 10. A cylindrical projection 15 projecting toward the cosmetic sponge container 20 is formed in the upper part of the cutout portion 13 of the contact surface 12.

The cosmetic sponge container 20 has a cylindrical shape and is formed with a contact surface 22 in contact with the cosmetic brush container 10. A sponge 21 is inserted in the upper side of the cosmetic sponge container 20. A cover member 24 to cover the bottom of the cosmetic sponge container 20 and a cutout portion 23 formed in the lower part of the contact surface 22 is inserted in the lower side of the cosmetic sponge container 20. A round portion 25 to be inserted and mounted in the periphery of the cylindrical projection 15 of the cosmetic brush container 10 is formed in the upper part of the cutout portion 23 of the contact surface 22.

Next, an assembling procedure of the above-configured two-in-one apparatus having the brush and the sponge for cosmetics will be described. After making the cosmetic brush container 10 and the cosmetic sponge container 20 facing each other, when the cutout portion 23 of the cosmetic sponge container 20 is pushed in downward through the upper side of the cosmetic brush container 10, the round portion 25 in the cutout portion 23 is mounted in the periphery of the cylindrical projection 15.

In this state, the cover members 14 and 24 are fitted and assembled from below and the brush 11 and the sponge 21 are inserted in the upper sides of the containers 10 and 20, respectively, thereby completing the assembly (see FIG. 2).

Then, for use of the two-in-one apparatus, the cosmetic sponge container 20 is rotated by 180 degrees around the cylindrical projection 15 (see FIG. 3).

While the present invention has been particularly shown and described with reference to exemplary embodiments thereof, it will be understood by those skilled in the art that various changes in form and details may be made therein without departing from the spirit and scope of the present invention. The exemplary embodiments are provided for the purpose of illustrating the invention, not in a limitative sense. Thus, it is intended that the present invention covers the modifications and variations of this invention provided they come within the scope of the appended claims and their equivalents.

What is claimed is:

1. A two-in-one apparatus having a brush and a sponge for cosmetics, comprising a cosmetic brush container (10) and a cosmetic sponge container (20) which are symmetrical to each other and are rotatably attached in contact, wherein a cylindrical projection (15) projecting toward the cosmetic sponge container (20) is formed on the cosmetic brush container (10), and a round portion (25) to receive the cylindrical projection (15) of the cosmetic brush container (10) in a periphery of the round portion (25) is formed on the cosmetic sponge container (20), wherein the cosmetic brush container (10) has a cylindrical shape and is formed with a contact surface (12) in contact with the cosmetic sponge container (20), a brush (11) is inserted in an upper side of the cosmetic brush container (10), a first cover member (14) to cover the bottom of the cosmetic brush container 10 and a first cutout portion (13) formed in a lower part of the contact surface (12) is inserted in a lower side of the cosmetic brush container (10), and the cylindrical projection (15) projecting toward the cosmetic sponge container (20) is formed in an upper part of the first cutout portion (13) of the contact surface (12), and wherein the cosmetic sponge container (20) has a cylindrical shape and is formed with a contact surface (22) in contact with the cosmetic brush container (10), a sponge (21) is inserted in an upper side of the cosmetic sponge container (20), a second cover member (24) to cover the bottom of the cosmetic sponge container (20) and a second cutout portion (23) formed in a lower part of the contact surface (22) is inserted in a lower side of the cosmetic sponge container (20), and wherein the round portion (25) and the second cover member (24) receive the cylindrical projection (15).

2. The two-in-one apparatus according to claim 1, wherein the cosmetic sponge container (20) is rotated by 180 degrees around the cylindrical projection (15).

3. The two-in-one apparatus according to claim 1, wherein the cylindrical projection (15) comprises a pair of protrusions formed on opposite sides of the cylindrical projection (15) and the second cover member (24) comprises a groove which is constructed to receive the protrusion.

4. A two-in-one apparatus having a brush and a sponge for cosmetics, comprising a first container (10) and a second container (20) which are symmetrical to each other and are rotatably attached in contact, wherein a cylindrical projection (15) projecting toward the first container (10) is formed on the second container (20), and a round portion (25) to receive the cylindrical projection (15) in a periphery of the round portion (25) is formed on the first container (10), wherein the first container (10) has a cylindrical shape and is formed with a first contact surface (12) in contact with the second container (20), and a first cover member (14) to cover the bottom of the first container (10) and a first cutout portion (13) formed in a lower part of the first contact surface (12) is inserted in a lower side of the first container (10), and wherein the second container (20) has a cylindrical shape and is formed with a second contact surface (22) in contact with the first container (10), and a second cover member (24) to cover the bottom of the second container (20) and a second cutout portion (23) formed in a lower part of the second contact surface (22) inserted in a lower side of the second container (20), where in the cylindrical projection (15) is formed in an upper part of the second cutout portion (23) of the second contact surface (22) and the round portion (25) and the first cover member (14) receive the cylindrical projection (15).

5. The two-in-one apparatus according to claim 4, wherein the second container (20) is rotated by 180 degrees around the cylindrical projection (15).

6. The two-in-one apparatus according to claim 4, wherein the cylindrical projection (15) comprises a pair of protrusions formed on opposite sides of the cylindrical projection (15) and the first cover member (14) comprises a groove which is constructed to receive the protrusion.

* * * * *